US008733681B2

(12) United States Patent
Pallmann

(10) Patent No.: US 8,733,681 B2
(45) Date of Patent: May 27, 2014

(54) APPARATUS FOR COMMINUTING FEEDSTOCK

(75) Inventor: Hartmut Pallmann, Zweibruecken (DE)

(73) Assignee: Pallmann Maschinenfabrik GmbH & Co. KG, Zweibruecken (DE)

( * ) Notice: Subject to any disclaimer, the term of this patent is extended or adjusted under 35 U.S.C. 154(b) by 382 days.

(21) Appl. No.: 13/283,544

(22) Filed: Oct. 27, 2011

(65) Prior Publication Data

US 2012/0104133 A1 May 3, 2012

(30) Foreign Application Priority Data

Oct. 27, 2010 (DE) ..... 20 2010 014 692 U

(51) Int. Cl.
*B02C 23/20* (2006.01)

(52) U.S. Cl.
USPC ..... 241/60; 241/73; 241/242

(58) Field of Classification Search
USPC ..... 241/60, 73, 242
See application file for complete search history.

(56) References Cited

U.S. PATENT DOCUMENTS 2,225,781 A * 12/1940 Hinerfeld ..... 241/73
4,650,129 A * 3/1987 Newell et al. ..... 241/73
4,664,320 A * 5/1987 Steffens ..... 241/60
4,934,614 A * 6/1990 Lewis ..... 241/73
5,746,377 A * 5/1998 Gehrig ..... 241/73
6,079,647 A * 6/2000 Leduc et al. ..... 241/73
6,343,753 B1 * 2/2002 Janssen ..... 241/100
2007/0063080 A1 * 3/2007 Evans et al. ..... 241/73

FOREIGN PATENT DOCUMENTS

DE 10 2006 036 738 A1 2/2008
EP 1 371 420 A1 12/2003

* cited by examiner

*Primary Examiner* — Faye Francis
(74) *Attorney, Agent, or Firm* — Muncy, Geissler, Olds & Lowe, P.C.

(57) ABSTRACT

Apparatus for comminuting pourable feedstock, including a housing surrounding a comminution space, in which housing a rotor rotating about an axis is disposed, the rotor being equipped around its circumference with rotor tools. A screen is disposed here along one portion of the rotor circumference. The apparatus is charged with feedstock through a product inlet, and the sufficiently comminuted product is drawn off through a product discharge. The product discharge includes a suction bin to collect the screen through fraction, which bin can be connected to a suction line to allow the collected product to be transported away. In order to improve the accessibility of the rotor for repair and maintenance work while simultaneously preserving a compact constructive design of the apparatus, the screen and the suction bin form one unit that can be swiveled as a whole about a horizontal swivel axis relative to the rotor.

14 Claims, 3 Drawing Sheets

APPARATUS FOR COMMINUTING FEEDSTOCK

This nonprovisional application claims priority under 35 U.S.C. §119(a) to German Patent Application No. DE 20 2010 014 692.5, which was filed in Germany on Oct. 27, 2010, and which is herein incorporated by reference.

BACKGROUND OF THE INVENTION

1. Field of the Invention

The invention relates to an apparatus for comminuting pourable feedstock.

2. Description of the Background Art

Apparatuses of this type are associated with the field of mechanical process engineering and function to convert source materials into intermediate and end products of a predetermined shape and size. The goal of the conversion process here is to obtain a product that is as uniform as possible within narrow tolerances in terms of shape and size. This is achieved, inter alia, by disposing a screen downstream from the comminution zone, the screen through fraction of which meets the requirements for the product within specified tolerances.

DE 10 2006 036 738 A1 discloses a cutting mill comprising a rotor, the rotor tools of which interact with stator tools that are disposed in stationary fashion on the mill housing so as to comminute the feedstock. The lower peripheral section of the rotor is surrounded by a screen, while the upper section functions to deliver the feedstock. Below the screen, the housing transitions into a suction bin, the funnel-shaped peripheral walls of which conduct the comminuted product to the bottom of the bin where it is discharged from the apparatus in the air flow through a suction line. The disadvantage of this apparatus is found in the suction bin that is disposed in the form of an independent component below the housing, thereby necessarily requiring a large machine height and thus necessitating a corresponding amount of space at the operating location. This type of machine design has also proven disadvantageous in terms of the accessibility of the rotor or to the perforated metal sheets of the screen, since the suction bin has to be removed first, followed by the screens, in order to access the interior of the machine—and this is found to be a very labor-intensive and time-intensive process. The economic efficiency of these cutting mills thus suffers significantly due to the extended downtimes caused thereby.

EP 1 371 420 A1 discloses a swivel drive for a screen in order to reduce the time-intensive labor component, the drive using hydraulic cylinder-piston units to move the screens downward about a horizontal swivel axis at the top longitudinal edge of the screen frame. This significantly simplifies the removal of the screen; it presupposes, however, that there is sufficient space in the downward direction to effect the swivel motion. If additional functional components have been provided—for example, a suction bin that necessarily must be positioned below the screen—this space is no longer available unless the overall height of the apparatus is increased considerably. In addition, the action of swiveling up the screen through the rotor-proximate positioning of the swivel axis results in a tight, spandrel-shaped space created by the screen and rotor, which space significantly impedes accessibility to the rotor in this region.

SUMMARY OF THE INVENTION

It is therefore an object of the present invention to ensure the rapid and easy accessibility of the rotor and screen even for apparatuses that include a suction bin, without thereby giving up the compact constructive design of the apparatus.

The invention is based on the knowledge that the kinematics of the moving parts are of critical significance for an apparatus according to the invention both in terms of good accessibility as well as a compact constructive design. One the one hand, the approach must ensure that the screen can be swiveled without interference into its top operating position and bottom operating positions. On the other hand, the overall height of the apparatus should not be fundamentally enlarged by the swivel action. This problem is compounded if another component in the form of a suction bin is disposed below the screen, the overall height of which is critical to the machine height. The designer thus finds himself/herself in a zone of tension, whereby he/she must, on the one hand, allow the greatest possible swivel motions so as to improve the accessibility of the apparatus. On the other hand, due to the generally tight space available at the place of installation the apparatus should be of the most compact constructive design possible, which aspect in turn is in conflict with large swivel motions.

This conflict is resolved according to the invention by integrating the suction bin in the screen. The invention provides an approach whereby the individual functional components, such as screen and suction bin, are combined into one rigid machine component, and the machine component is retracted from or extended into the operating position by means of a swivel mechanism. As a result, it is possible to remove both the screen and also the suction bin from the working region of the rotor in only one step, with the result that both the rotor and the perforated metal sheet easily accessible. This first of all enables the expenditure of time for repairs or replacing tools to be significantly shortened. The downtimes for apparatuses according to the invention thus turn out to be significantly shorter than for known apparatuses, and this ultimately has a positive effect on the economic efficiency of an apparatus according to the invention.

The integration of the suction bin in the screen results in an essentially constructive merging of the two functional components. This is achieved in a preferred embodiment of the invention by an approach wherein the screen support frame is employed not only to affix the perforated metal sheet, but also simultaneously to retain the peripheral walls of the suction bin. The vertical extent of the screen is thus utilized simultaneously for the vertical overall height of the suction bin, and this directly benefits a short compact constructive design. In a development of this idea, the end ribs of the screen support frame simultaneously form the end walls that axially define the suction bin.

Another aspect that has been found with the invention is the fact that the position of the swivel axis of the screen and suction bin have a significant effect on the kinematics. The inventive arrangement of the swivel axis succeeds in combining the requirements, which at first glance seem mutually exclusive, of providing both easy accessibility and also a compact constructive design. In a preferred implementation of the invention, the swivel axis of the screen is situated at the level or higher than the level of the lower vertex of the circular path of the rotor tools. This results in a relatively high positioning of the swivel axis, thereby creating space towards the bottom for the upward swivel motion, without at the same time significantly increasing the overall height of the apparatus.

Since access to the rotor is implemented laterally by the apparatus according to the invention, another advantage is yielded by the position of the longitudinal edges of the screen that occupy a site at their top operating position in which a plane defined by the longitudinal edges is tilted towards the swivel axis. After the screen swivels down, the rotor is thus accessible not only from below but also simultaneously from the side.

In another embodiment of the invention, the distance of the swivel axis from the rotor axis is at least 1.5 times, preferably 2 times, the rotor radius. This distance significantly enhances the accessibility to the apparatus since a considerable radial distance from the rotor is created over the entire extent of the screen by swiveling the screen down to its bottom end position.

In an embodiment, the maximum swivel angle between the two end positions of the screen can measure 60°, initially restricting the overall height of the apparatus. This advantage can be optimized further if the angle between a horizontal plane and the top end positoion of the screen is a maximum of 40°, and/or the angle between the bottom end position and the horizontal plane is a maximum of 20°. This results in a swivel motion about the horizontal plane in which changes in angle very effectively produce a maximum vertical screen opening.

One development of the invention employs only one screen, thereby simplifying the swivel mechanism since the mechanism only needs to be provided once. Nevertheless, this approach also significantly simplifies the integration of the suction bin in the screen. The screen here advantageously extends across nearly half the rotor circumference, for example, by at least 140°, preferably however, 160°.

The following discussion describes the invention in more detail based on an exemplary embodiment illustrated in the drawing from which additional features and advantages are revealed. The embodiment elucidates the invention based on a cutting mill, without being restricted thereto. Shredders, hammer mills, impact mills, and the like that feature a rotating comminution system, in which the comminuted product is drawn off through a screen and collected in a suction bin, are also within the scope of the invention.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
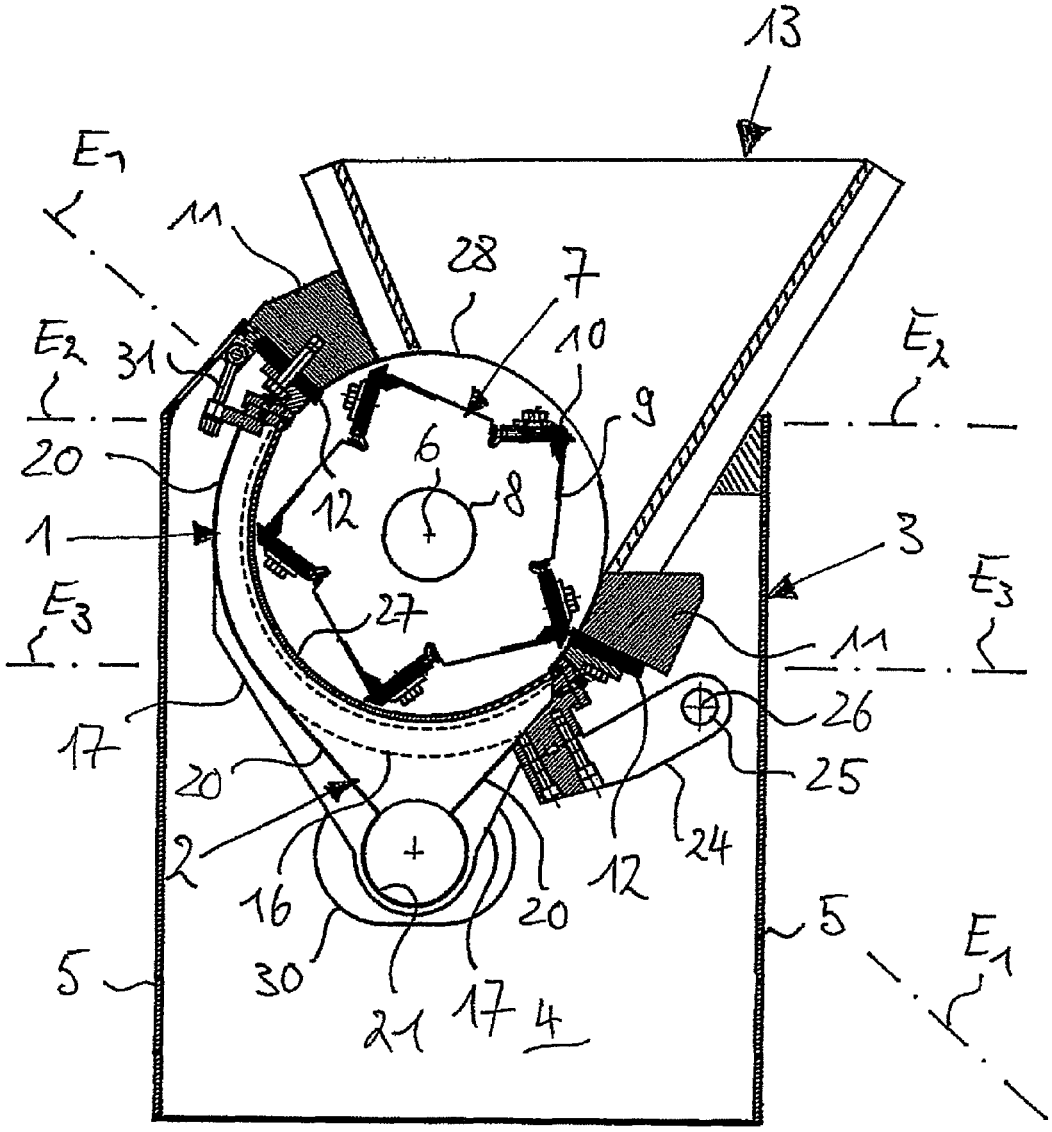
FIG. 1 illustrates a cross-section through an apparatus according to the invention when operating.
Figure 2:
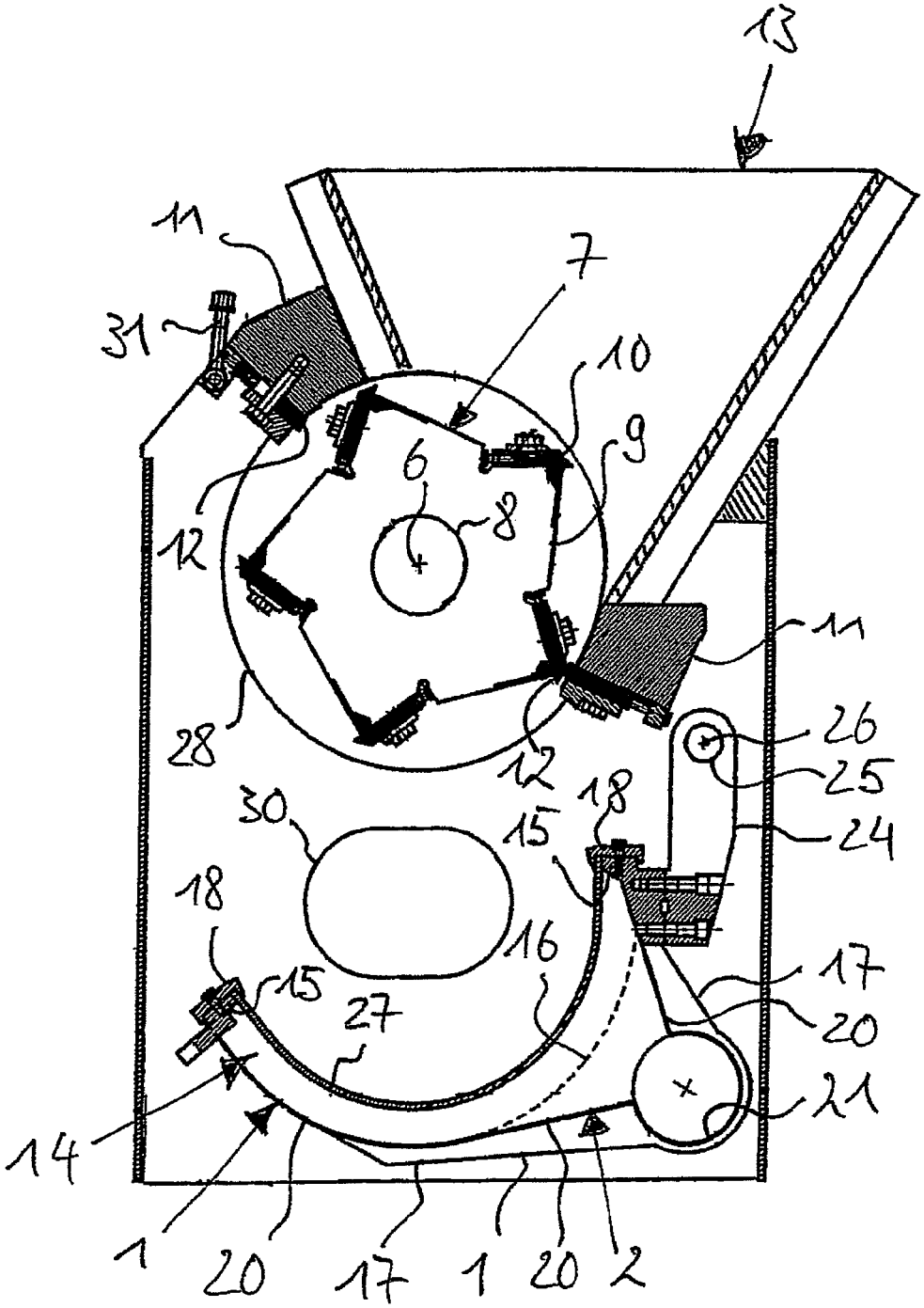
FIG. 2 illustrates a cross-section through the apparatus illustrated in FIG. 1 when in its state allowing repair and maintenance.

FIGS. 1 and 2 illustrate an apparatus according to the invention in the form of a cutting mill, where FIG. 1 depicts the operating state in which screen 1 and suction bin 2 have been swiveled into a top end position, while FIG. 2 depicts the state allowing repair and maintenance in which screen 1 and suction bin 2 are located at a bottom end position.

The cutting mill has a housing 3 that surrounds a comminution space by its transverse walls 4 and longitudinal walls 5. A rotor 7, which rotates about horizontal axis 6, is rotatably mounted on transverse walls 7. Rotor 7 comprises a drive shaft 8 on which multiple rotor disks 9 are seated in an axially staggered configuration. Rotor tools 10 are distributed uniformly around the circumference of rotor 7 and describe a common circular path by their blades. In the regions directly opposite rotor 7, transverse walls 4 are each fitted with a wear plate 28. Transverse walls 4 have orifices 30 at the level of suction bin 2 to allow passage of a suction line, not shown.

In addition, transverse walls 4 are attached by two massive cutter bars 11 that are axially parallel to axis 6, which cutter bars are situated approximately diametrically opposite to axis 6 and to which stator cutters 12 are affixed by cutter retaining plates and screws. Stator cutters 12 here extend radially towards rotor tools 10 with which they interact to comminute the feedstock. In addition, a locking mechanism 31 is disposed on right cutter bar 11 in FIG. 1, by means of which mechanism screen 1 can be secured at its top end position. Visible in the region of the top peripheral section between both cutter bars 11 is a funnel-shaped product inlet 13 through which the feedstock is fed to rotor 7.

Figure 3:
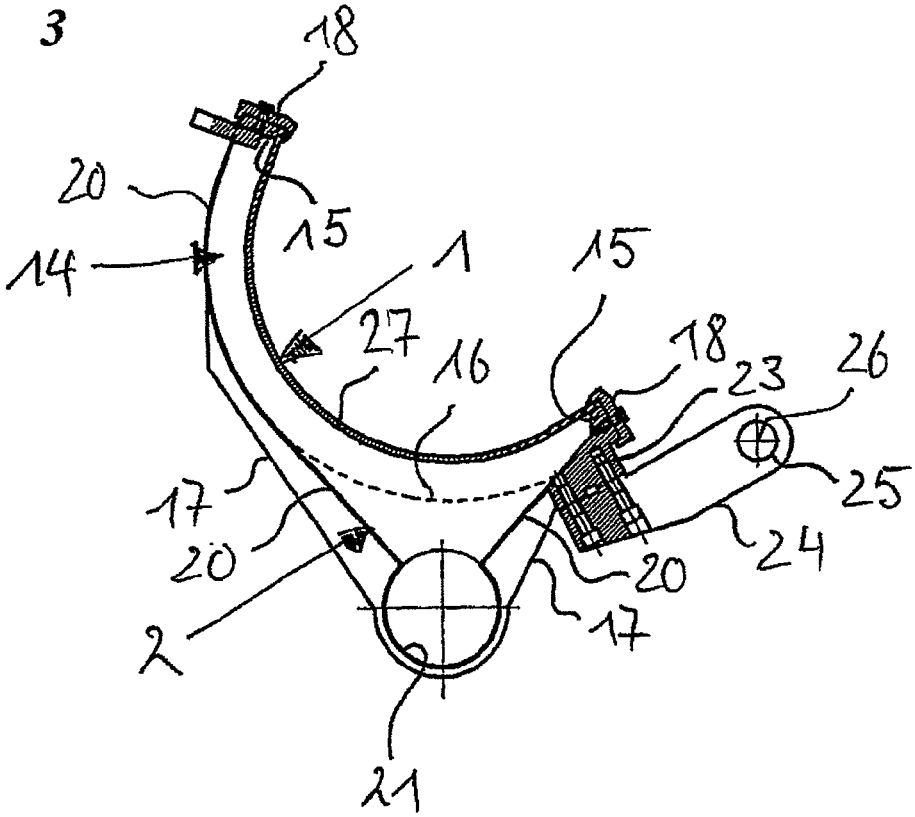
FIG. 3 illustrates a section through screen and suction bin along line III-III shown in FIG. 3.
Figure 4:
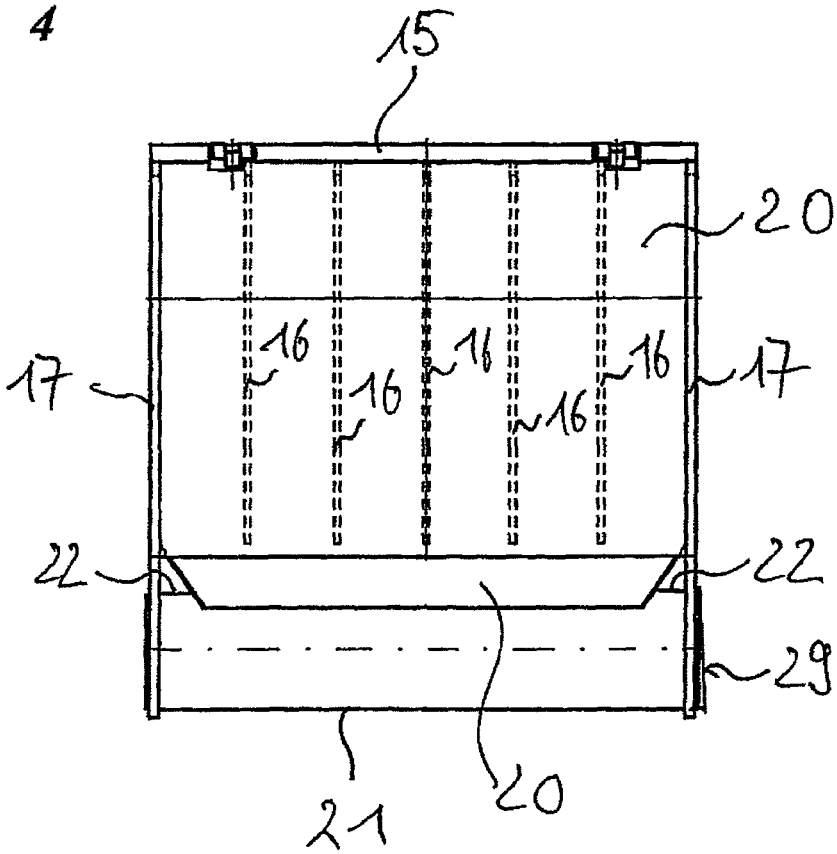
FIG. 4 is a view of screen and suction bin along the line IV-IV shown in FIG. 3.

The opposing peripheral section of rotor 7 functions to classify the comminuted product by screen 1, and to collect and conduct away the screen through fraction by means of suction bin 2. Screen 1 and suction bin 2 form an integral component, that is, they are constructively merged into a single component. The precise constructive design of this component is illustrated in detail in FIGS. 3 and 4. Screen 1 comprises a screen support frame 14 that is essentially composed of two longitudinal profile sections 15 that are parallel to rotational axis 6, which profile sections delimit screen 1 circumferentially. The two longitudinal profile sections 15 are attached circumferentially by arcurate ribs 16, of which end-face end ribs 17 are identified. The interior side of screen support frame 14 supports a perforated metal sheet 27, for which attachment is effected by connecting blocks 18 extending along longitudinal profile sections 15. Connecting blocks 18 encompass the parallel longitudinal edge of perforated metal sheets 27 and clamp these tangentially against longitudinal profile sections 15. What is achieved thereby is that perforated metal sheet 27 exactly follows the inside contour of ribs 15, 16.

By their sections adjoining longitudinal profile sections 15, the exterior sides of ribs 16 function to affix the bent portion of peripheral wall 20 of suction bin 2. Peripheral wall 20 transitions tangentially downward into a straight, funnel-shaped region and terminates at its low point in a bin-shaped rounded trough 21 to which one pipe connector 22 each attaches axially at the end. End ribs 17 of screen 1 form the end closure of suction bin 2, which end ribs are routed for this purpose up to rounded trough 21 or pipe connectors 22, and extend across the entire width spanned by peripheral walls 20. Pipe connector 22 terminates in a plane 29 that is tilted from the vertical plane towards the longitudinal axis of the connector so as to implement a connection of pipe connector 22 to the suction line, not shown, when screen 1 together with suction bin 2 is swiveled up. The suction line is of a form that is complementary thereto.

To swivelably attach screen 1 together with suction bin 2 inside housing 3, screen support frame 14 has brackets 23 to rigidly connect arms 24 that are seated in a rotationally fixed manner on a shaft 25 that is parallel to rotational axis 6. By employing a swivel drive, not shown—for example, in the form of a cylinder-piston unit that acts through a lever on a shaft 25—screen 1 together with suction bin 2 can be moved about the swivel axis 26 from the top end position shown in FIG. 1 to the bottom end position shown in FIG. 2, so as to ensure accessibility to perforated metal sheet 27 and rotor 7.

In addition, a plane $E_1$ is visible in FIG. 1 that is defined perpendicular to the plane of representation by the two longitudinal profile sections 15 of screen support frame 14. The fact that right longitudinal profile section 15 is situated lower than opposing left longitudinal profile section 15 produces a tilt $E_1$ toward swivel axis 26. FIG. 1 also reveals that swivel axis 26 runs above this plane $E_1$.

In addition, FIG. 1 illustrates the horizontal planes $E_2$ and $E_3$ running perpendicular to the plane of representation, the position of these planes being defined by top longitudinal profile section 15 and bottom longitudinal profile section 15. In this embodiment, swivel axis 26 is located below these two planes when in the operating position.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An apparatus for comminuting pourable feedstock, the apparatus comprising:

a housing surrounding a comminution space;

a rotor rotating about an axis, the rotor being arranged within the housing and equipped around its circumference with rotor tools; and a screen arranged along one portion of the rotor circumference, the screen comprising a product inlet to charge the apparatus with feedstock and comprising a product discharge to draw off sufficiently comminuted product, wherein the product discharge includes a suction bin configured to collect the screen through fraction, the bin being connectable to a suction line to allow the collected product to be transported away, and wherein the screen and the suction bin form one unit that are configured to be swiveled as a whole about a horizontal swivel axis relative to the rotor.

2. The apparatus according to claim 1, wherein the swivel axis lies at a level of or higher than a bottom vertex of the circle of path of the rotor tools.

3. The apparatus according to claim 1, wherein two axially running longitudinal edges of the screen define a plane, and wherein the plane is tilted toward the swivel axis.

4. The apparatus according to claim 1, wherein the two axially running longitudinal edges of the screen define a plane, and wherein the swivel axis lies in or above this plane.

5. The apparatus according to claim 1, wherein the swivel axis lies below two horizontal planes that are defined by two axially running longitudinal edges of the screen.

6. The apparatus according to claim 1, wherein a distance of the swivel axis from the rotational axis is at least 1.5 times the radius of the rotor or two times the radius.

7. The apparatus according to claim 1, wherein the screen extends at least over 140° or 160° of the rotor circumference.

8. The apparatus according to claim 1, wherein an angle between a top end position of the screen and the suction bin and a bottom end position is a maximum of 60°.

9. The apparatus according to claim 1, wherein an angle between a top end position of the screen and the suction bin, and wherein a horizontal plane through a swivel axis is a maximum of 40°.

10. The apparatus according to claim 1, wherein an angle between a top end position of the screen and the suction bin, and wherein a horizontal plane through a swivel axis is a maximum of 20°.

11. The apparatus according to claim 1, wherein the screen support frame is fitted at its side facing the rotor with a peforated metal sheet, and at its opposite side with a continuous metal sheet forming peripheral walls of the collection bin.

12. The apparatus according to claim 1, wherein the end-face end ribs of the screen support frame form the end walls of the collection bin.

13. The apparatus according to claim 1, wherein the screen has at least one connecting block that is axially parallel to the rotational axis in order to affix the peforated metal sheet to the screen support frame, which connecting block tangentially pretensions the edge of the peforated metal sheet associated with the connecting block.

14. The apparatus according to claim 1, wherein a pipe connector is disposed at the base of the collection bin for connection to a suction line, and wherein a connecting plane of the pipe connector is tilted relative to a perpendicular plane towards the longitudinal axis of the pipe connector.

* * * * *